US005650382A

United States Patent [19]

Deruyck et al.

[11] Patent Number: 5,650,382

[45] Date of Patent: Jul. 22, 1997

[54] ADDITIVE FOR LUBRICANTS CONTAINING A METAL COMPLEX

[75] Inventors: Frank Deruyck, Ghent; Wilfried Coppens, Kortrijk, both of Belgium

[73] Assignee: N.V. Bekaert S.A., Zwevegem, Belgium

[21] Appl. No.: 423,343

[22] Filed: Apr. 18, 1995

Related U.S. Application Data

[62] Division of Ser. No. 313,727, Sep. 26, 1994, which is a continuation of Ser. No. 946,478, Jan. 14, 1993, abandoned.

[51] Int. Cl.[6] ..... C10M 173/00; C10M 133/00

[52] U.S. Cl. ..... 508/367; 72/42; 508/375

[58] Field of Search ..... 252/32.5; 508/367, 508/371, 375

[56] References Cited

U.S. PATENT DOCUMENTS

| | | | |
|---|---|---|---|
| 2,976,238 | 3/1961 | Elliott et al. | 252/32.5 |
| 3,624,115 | 11/1971 | Otto et al. | 252/32.5 |
| 3,791,804 | 2/1974 | Branner et al. | 252/33 |
| 4,666,617 | 5/1987 | Katayama et al. | 252/32.5 |

*Primary Examiner*—Jacqueline V. Howard
*Attorney, Agent, or Firm*—Cushman Darby & Cushman IP Group of Pillsbury Madison & Sutro, LLP

[57] ABSTRACT

An additive for lubricants including a dispersible metal complex compound containing phosphorus and nitrogen. This complex compound consists of a co-ordination compound containing a fatty acid residue and at most one RCOO group per two metal atoms. Zinc is the metal of preference. Utilization for wet drawing of metal wire.

27 Claims, 1 Drawing Sheet

ADDITIVE FOR LUBRICANTS CONTAINING A METAL COMPLEX

Figure 1:
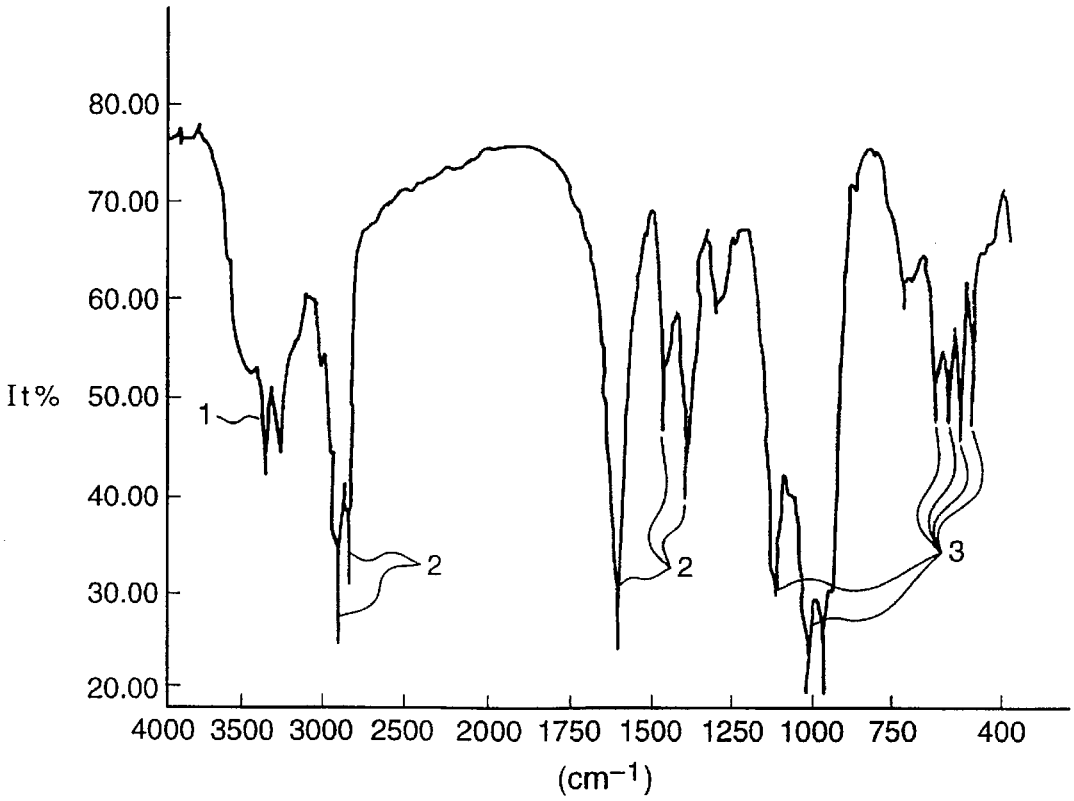

This is a division of application Ser. No. 08/313,727, filed Sep. 26, 1994, pending which is a Continuation of application Ser. No. 07/946,478 filed Jan. 14, 1993 (now abandoned).

The present invention relates to an additive for lubricants in the form of a metal complex compound containing phosphorous and nitrogen (especially in the case where it is bonded as amine). It also relates to the utilization of this additive in lubricants for metals, in particular for the working of metal surfaces. This implies that the complex compound must be dispersible in oils or in oil/water emulsions. In particular, the complex compound is utilized as a high pressure additive for the drawing of steel wire.

In general, oil-in-water lubricant emulsions are used for the so-called wet drawing of steel wire. With this type of wire drawing, extremely high frictional pressures occur between the wire surface and the surface of the die hole. The lubricants must therefore be composed in such a way that under these very high pressures (accompanied by increased frictional temperatures) they still ensure sufficient lubricating properties—in particular, boundary layer lubrication. For this purpose specific substances, so-called high pressure additives (HPA), are sometimes added to the lubricant, e.g. phosphates or metal phosphorodithionates. Under the high frictional pressures between the metal surfaces and the processing tools (e.g. a die), these HPA's are capable of forming reaction products which, when adsorbed on these surfaces, resist these extreme pressures. These reaction products can be complex metal-organic compounds. Their chemical structure is not always known.

In the lubrication of wire surfaces during wet drawing, a part of the active lubricating components—in particular, a part of the HPA absorbed on the wire surface—are obviously carried with the wire surface and thus consumed. Other waste products can be generated, (e.g. metal particles formed by wear and tear), along with the reaction products between components of the lubricant emulsion and the material of the surfaces in frictional contact. This is of course important to maintain the composition of the lubrication emulsion as constant and optimal as possible in order to ensure a continuously satisfactory lubrication, preferably at high drawing speeds, i.e. over 700 m/min. Up to now, this has been done by changing the lubricant (i.e. replacing a given amount of old lubricant with an equal amount of new) and, moreover, by adding active lubricating components in concentrated form (e.g. the oil phase of the emulsion) to compensate for the amount consumed. However, this is not always effective.

It is an object now of the present invention to provide means which, either generated in or added to the lubricant emulsion, and possibly in combination with the above-mentioned periodical changes of and compensatory additions to the lubricant emulsions, will enable the lubricating quality to be maintained at a satisfactory level. In this way, it may become possible to lower the earlier frequency of replacing and adding lubricant. The addition of lubricant controlled by time, amount or other conditions thus makes it possible to regulate the lubrication quality efficiently and easily and to maintain it at a satisfactory level. The choice of the lubricating means can also be adapted to the nature of the friction and the type or nature of the surfaces in frictional contact. It is also an object of the invention to provide methods for the preparation of these means of lubrication.

The means of lubrication that, according to the invention, fulfill these requirements, can in principle be regarded as being high-pressure additives that include a metal complex compound containing phosphor and amine that is dispersible in oil or oil emulsions and that result in a better boundary layer lubrication for metal surfaces that are in frictional contact. It is typical in this respect that the complex compound consists of a co-ordination compound containing a fatty acid residue (RCOO) with at most one fatty acid residue group per two metal atoms. The phosphorus will by preference be bonded in a phosphate group (PO4). Zinc is the metal of preference. The fatty acid residue group can be either saturated (e.g. a stearate) or unsaturated (e.g. an oleate), and will by preference contain from 12 to 22 carbon atoms. The bonded amino group also plays an important role in the compound. Diamines (DA), whether substituted or not, are preferred, (e.g. 1,2 or 1,3-diamines). Ethylene diamine (EDA), whether substituted or not, is especially suitable. The substituents here can include alkyl, alkylene, alkoxy, aryl, or arylene groups or their respective cyclo-analogues.

It was determined that a series of suitable means according to the invention can be described with the general formula:

$$[M(DA)_n(RCOO)_x]_y(PO_4)_z$$

in which $0<n\leqq 0.5$, $0<x\leqq 0.5$, $2<y\leqq 3$ and $1\leqq z\leqq 2$ and in which M represents a metal. This formula refers in general to a co-ordination compound.

How the phosphate groups are bonded (ionically, co-ordinationally, or through a different interaction), cannot yet be determined with certainty. Therefore, the indication of $(PO_4)_z$ in the formula above (and below) should not be strictly interpreted as referring only to a phosphate ion. In general, higher x values favor the dispersiveness. There is a special preference here for the co-ordinative compound having the formula $$[Zn(EDA)_n(RCOO)_x]_y(PO_4)_z$$

in which n–0.5, x–0.5, y–2, z–1 and in which EDA stands for bonded ethylene diamine. When 70% by weight of the RCOO group in the latter compound is an oleate, then hereinafter it is simply called a "zinc oleate complex" (ZOC). These specific substances have certain infrared spectra with characteristic peaks at the wave number values of 1400 and 1622 $cm^{-1}$, which indicate co-ordinationally bonded oleate groups.

Explanations will now be given in more detail on the basis of the characterization of a preferred embodiment: the ZOC, in accordance with the attached figures; the method for its preparation and a friction test to demonstrate its unique lubricating properties.

FIG. 1 is an infrared spectrum of the ZOC.

The ZOC can be synthesized, for example, by letting zinc oxide (1.5 g/l) react with phosphoric acid (1.5 g/l), EDA (0.8 g/l) and oleic acid (4 g/l) for about 24 hours at approximately 50° C. and with a pH of approximately 8.3. The reaction product can be regarded as being essentially a zinc phosphate that includes co-ordinationally* bonded ethylene diamine and fatty acids. In order to maintain a stable dispersion in the lubricating fluid, the colloidal particles—which generally have the shape of platelets or scales—have dimensions of, by preference, between 0.2 and 10 microns.

The ZOC compound presumably contains co-ordinationally bonded groups with the following structure:

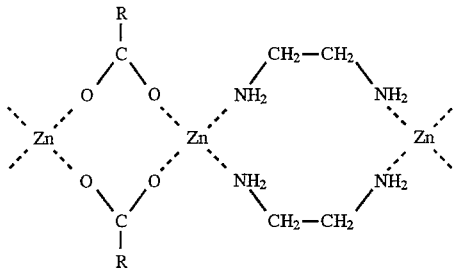

According to the applicant, however, at the present time the preferred substances according to the invention can be sufficiently characterized only by their specific infrared transmission spectrum, as shown in the drawings. A number of claims therefore must necessarily refer to the drawing in order to describe these preferred substances which are to be protected (by patent).

The infrared transmission spectrum in FIG. 1 shows characteristic (downwardly pointed) peaks for the zinc-oleate complex. The transmission percentage shown in the ordinate for these peaks is low, which indicates a high absorption of the infrared radiation at the corresponding wave numbers (i.e. the inverse of the wave lengths). The peaks 1 at approximately 3250–3350 indicate ethylene diamine components, while the peaks 2 around 2900, around 1620 and 1400–1470 refer to oleate groups. The peaks 3 at approximately 1000–1130 and at 500–630 are related to phosphorus-containing groups (including phosphate groups).

Characteristic peaks occur at the wave numbers 518, 554, 591, 625, 722, 985, 1029, 1127, 1304, 1400, 1464, 1622, 2854, 2925, 3279 and 3353. The wave frequencies underlined are regarded as being the most important. A fatty acid analysis (by gas chromatography) of the ZOC will always indicate a fatty acid content of 30–50% by weight.

In order to evaluate the lubricating efficiency, an ordinary fresh oil-in-water lubricating emulsion with a concentrated oil phase of about 5% by weight was used for steel rods in the standard Falex friction test. This oil phase contains the standard ingredients such as fatty acids, amines and detergents. For the purpose of comparison, the same Falex test was carried out for the same lubricating emulsion, but now with a well dispersed quantity of on the one hand approximately 1 g/l and on the other hand 6 g/l of ZOC, the high-pressure additive developed according to the invention. Each time, the frictional force was about 5000 N and the friction time was 1 hour. At the end of the test it turned out that 11.2 mg of metal was worn off the steel rods with the application of the fresh lubricating emulsion without ZOC. In the tests where ZOC was used, surprisingly enough, the metal loss remained extremely low, as is apparent from the table below. At the same time, microscopic inspection of the rod surfaces showed the most damage on the rods that were tested with little or no ZOC added.

AES depth profiles on the tested rod surfaces indicate that the more ZOC was added, the higher the zinc and phosphorus content found on the rods. Table 1 shows these contents (transmission percentage—at %) of zinc and phosphorus, along with the corresponding amounts of iron. A higher iron content means that the reaction film is clearly thinner. This may indicate the specific action as high-pressure additive that, according to the invention, is attributable to the ZOC. The observation that much less Zn and P (and more iron) is present on the damaged areas than on areas that are not damaged is also remarkable. This means that, through the reaction of ZOC with the steel surface, a lubricant film has formed that offers exceptional protection against further wear.

TABLE 1

| at % | with 6 g/l ZOC | with 1 g/l ZOC | without ZOC |
|---|---|---|---|
| zinc | 23–33 | 9–12 | 0 |
| phosphorus | 6–16 | 5–7 | — |
| iron | 5–10 | 10–20 | — |
| metal worn off (in mg) | 0.2–0.3 | 1–2 | 11.2 |

The previously described means (substances)can be applied ith success for the drawing of metal wire, and in particular for the wet drawing of metal wire in an oil-in-water lubricant emulsion. Good lubrication is of essential importance for obtaining high productivity in the wire drawing process. Wire ruptures during the drawing process are an important cause of lowered productivity. They are mainly the result of the continuing demand, on the one hand, to increase the drawing speeds and, on the other hand, the continuous increase of ultimate tensile strengths that are required, for example, for steel wires used in reinforcing vehicle tires. Steel wires for rubber reinforcement generally have a carbon content of over 0.7%, and even of over 0.8%. Their tensile strengths currently often lie above 3000 $N/mm^2$. In order to achieve a satisfactory adhesion to the surrounding elastomer, they are, for example, provided with a coating layer of brass or zinc.

EXAMPLE

A standard fresh oil-in-water lubricant emulsion was utilized for the wet drawing of a brass coated steel wire (0.80% C) from a diameter of 1.70 mm to a diameter of 0.30 mm. The drawing speed was 600 m/min. The drawing force (required pull through force) was measured on the wire where it exited from the last die. The higher the required drawing force, the poorer the lubrication performance.

The same drawing test was repeated with the same lubricant emulsion, in which now, however, the ZOC was present in the emulsion in a finely dispersed form. The required drawing force was decreased to about 75% of that recorded in the previous test. In practice, for brass or zinc-coated steel wire for rubber reinforcement, not only do the good drawing properties play a role, but at the same time the lubricant residue on the wires after drawing should not impair the compatibility with—and especially the adhesion to—the rubber. The lubricant residue amount (in particular, the reaction product of ZOC and metal formed in situ) on the wire surface should not rise too high, for example, for particular rubber compositions.

Although the invention has shown its benefits specifically for particular oil-in-water emulsions, it is clear that in principle it can be utilized for other lubricants—whether mineral or synthetic, animal or plant oils, or mixtures thereof and for lubricants that may include still other components such as rust inhibitors, surface-active substances, HPA, anti-foaming means, antioxidants, bactericides, viscosity regulators, metal deactivators, etc. Among other things, it can be utilized in cutting oils and lubricating oils for gears drives, bearings and transmission boxes.

We claim:

1. A process for lubricating metal wire when drawn under high pressure comprising the step of contacting metal wire to be drawn with a composition comprising a zinc complex compound which contains phosphorus and diamines and which is dispersible in oils or oil emulsions, characterized in that it consists of a composition containing a $C_{12}$–$C_{22}$ fatty acid residue with at most one fatty acid residue group (RCOO) per two zinc atoms, and zinc is bonded with phosphate ion.

2. The process of claim 1, wherein the metal wire comprises steel.

3. The process of claim 2, wherein the metal wire comprises brass coated steel wire having a carbon content of over 0.7%.

4. The process of claim 2, wherein the metal wire comprises zinc coated steel wire.

5. The process of claim 2, wherein the steel wire has a tensile strength above 3000 $N/mm^2$.

6. A process for producing a lubricant composition comprising the steps of (i) reacting zinc oxide with phosphoric acid, a diamine and a $C_{12}$–$C_{22}$ fatty acid to form a zinc complex compound which is characterized in that it contains a $C_{12}$–$C_{22}$ fatty acid residue with at most one fatty acid residue group (RCOO) per two zinc atoms, and zinc is bonded with phosphate ion.

7. The process of claim 6, wherein the diamine is ethylene diamine.

8. The process of claim 6, wherein the fatty acid is oleic acid.

9. The process of claim 6, wherein the zinc complex compound has the formula $$[Zn(EDA)_n(RCOO)_x]_y(PO_4)_z$$

wherein $0<n\leqq 0.5$, $0<x\leqq 0.5$, $2<y\leqq 3$, $1\leqq z\leqq 2$, and EDA stands for bonded ethylene diamine.

10. The process of claim 9, wherein n equals approximately 0.5, x equals approximately 0.5, y equals approximately 2, and z equals approximately 1.

11. A method of working metal surfaces comprising the steps of i) contacting said surfaces with a liquid lubricant including as a high pressure additive a complex compound containing phosphorus and diamines dispersible in oils or oil emulsions, wherein said complex compound contains a $C_{12}$–$C_{22}$ fatty acid residue with at most one fatty acid residue group (RCOO) per two zinc atoms and zinc is bonded with phosphate ion, and ii) mechanically working said surfaces by applying high pressure frictional forces to said surfaces.

12. The method according to claim 11, wherein step ii) includes drawing wet wire.

13. The method according to claim 12, wherein the wire is a steel wire.

14. The method according to claim 13, wherein the wire is a steel wire has a carbon content of over 0.7%.

15. The method according to claim 13, wherein the steel wire is a brass-coated steel wire.

16. The method according to claim 13, wherein the steel wire is a zinc-coated steel wire.

17. The method according to claim 14, wherein the steel wire has a tensile strength above 3,000 $N/mm^2$ after wet wire is drawn.

18. The method according to claim 11, wherein the liquid lubricant is an oil-in-water emulsion.

19. The method according to claim 11, wherein the fatty acid residue group is unsaturated.

20. The method according to claim 11, wherein the fatty acid residue group consists of at least 70% by weight of oleate.

21. The method according to claim 11, wherein the diamine is a 1, 2 diamine or a 1, 3 diamine.

22. The method according to claim 11, wherein the diamine is ethylene diamine.

23. The method according to claim 11, wherein the diamine is a substituted diamine.

24. The method according to claim 11, wherein the complex compound has the following formula:

$$[Zn(EDA)_n(RCOO)_x]_y(PO_4)_z$$

wherein $0<n\leqq 0.5$, $0<x\leqq 0.5$, $2<y\leqq 3$, $<z<2$, and EDA stands for bonded ethylene diamine.

25. The method according to claim 24, wherein the fatty acid residue contains at least 70% by weight of oleate.

26. The method according to claim 11, wherein the complex compound has dispersible particle which have dimensions of between 0.2 and 10 microns.

27. The method according to claim 11, wherein the complex compound is characterized by having an infrared spectrum peak at approximately 32.50–33.50, indicating ethylene diamine components, infrared spectrum peaks at approximately 29,000, approximately 16,020, and approximately 14,000–14,070, indicating oleate groups, and infrared spectrum peaks at approximately 1,000–1,130 and approximately 500–630, indicating phosphorus-containing groups.

* * * * *